US006211467B1

(12) United States Patent
Berelsman et al.

(10) Patent No.: US 6,211,467 B1
(45) Date of Patent: Apr. 3, 2001

(54) LOW LOSS DATA CABLE

(75) Inventors: Timothy N. Berelsman, Delphos, OH (US); Rune Totland, Bergen (NO)

(73) Assignee: Prestolite Wire Corporation, Port Huron, MI (US)

( * ) Notice: Subject to any disclaimer, the term of this patent is extended or adjusted under 35 U.S.C. 154(b) by 0 days.

(21) Appl. No.: 09/369,456

(22) Filed: Aug. 6, 1999

Related U.S. Application Data

(60) Provisional application No. 60/095,816, filed on Aug. 6, 1998, now abandoned.

(51) Int. Cl.[7] ..... H01B 11/02
(52) U.S. Cl. ..... 174/113 R; 174/113 C
(58) Field of Search ..... 174/113 R, 113 C, 174/131 A, 27, 113 A, 113 AS, 121 A

(56) References Cited

U.S. PATENT DOCUMENTS 3,737,557 * 6/1973 Verne et al. ..... 174/113 R X
5,574,250 * 11/1996 Hardie et al. ..... 174/116 X
5,600,097 * 2/1997 Bleich et al. ..... 174/113 R X
5,952,607 * 9/1999 Friesen et al. ..... 174/27 X

* cited by examiner

*Primary Examiner*—Kristine Kincaid
*Assistant Examiner*—Chau N. Nguyen
(74) *Attorney, Agent, or Firm*—Rader, Fishman & Grauer PLLC

(57) ABSTRACT

A low loss data cable includes a plurality of conductor pairs combined to form a core, each conductor pair including coupled braided conductors where each conductor encircles its coupled conductor with each conductor encircling being defined as a pair lay length. A first insulating material layer separately insulates each of the conductors. A second insulating material layer, surrounds a core that includes the plurality of conductor pairs in a twist formation where each of the plurality of conductor pairs encircles a center gap separating all of the conductor pairs. When each conductor pair encircling is defined as a core lay length, the pair lay length of each of the conductor pairs is no greater than about one third of the core lay length.

20 Claims, 3 Drawing Sheets

FIG. 1
PRIOR ART
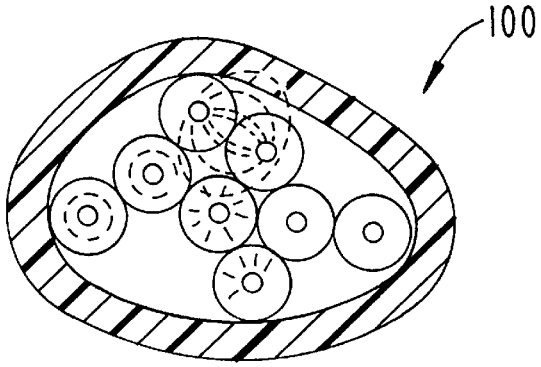
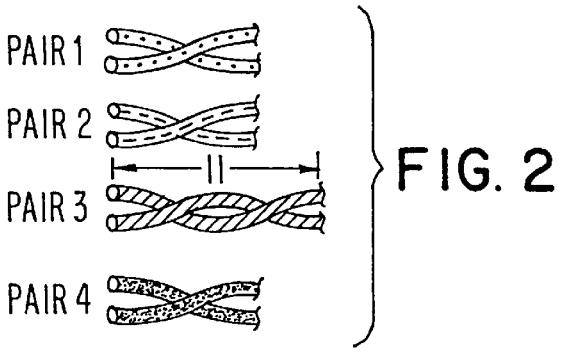
FIG. 2
FIG. 3
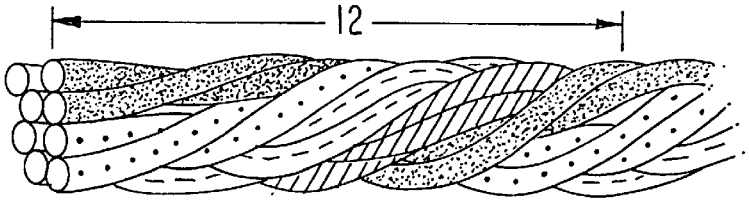
FIG. 4
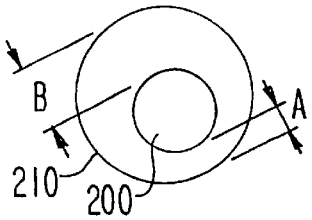

LOW LOSS DATA CABLE

RELATED APPLICATION

This application claims the priority of provisional application Ser. No. 60/095,816, filed Aug. 06, 1998, now abandoned.

FIELD OF THE INVENTION

The present invention relates to data cables which comprise braided conductor groups that are discretely configured with respect to one another.

BACKGROUND OF THE INVENTION

For the past decade, the popularity of IEEE 802.3 (Ethernet) networking technology and its technique for transmitting data signals over unshielded twisted pair wiring (UTP) has been the key driver defining cable performance parameters. This technology, however, was originally designed to allow transmission rates of 10 Megabits per second. During the early 1990s, the Ethernet networking technology was expanded to speeds of 100 Megabits per second over UTP.

Today, with the popularity of Internet and more powerful application software, users are demanding more bandwidth from their local area network (LAN). In order to meet such demands, a networking platform for 1000 Megabits per second transmission has been developed.

However, because the same basic principals that were proposed for operation at 10 Mbps were followed for production of the 1000 Mbps platform, this new design has become extremely complex and expensive. The new design has also become highly sensitive to cable parameters such as return loss, attenuation, crosstalk, ACR, delay skew, far end crosstalk and impedance.

To overcome these problems, new networking platforms and standards are being developed to be backwards-compatible with existing Ethernet systems. Systems incorporating these new standards employ a new transmission technology making them more robust while using less complex circuitry, yielding a more economical solution. The transmission technology used by these new systems is Pseudo Emitter Coupled Logic (PECL).

One system that utilizes the above-mentioned PECL transmission technology employs a high impedance output load along with PECL to produce a low power signal that makes the system virtually immune to near-end crosstalk or far-end crosstalk. However, because the system employs a low power input signal, it is extremely sensitive to attenuation and input impedance smoothness. The system also uses a low level encoding scheme, making it necessary for the nyquist (carrier) frequency to exceed 100 MHz. The actual nyquist frequency in the WideBand 1 Gb per second system is 167 MHz.

In light of the deficiencies of systems described above, along with their associated wiring technology, it is desirable to provide a simple and relatively inexpensive low loss data cable. It is also desirable to provide a low loss data cable that can be used in data networking systems, the data cable being less sensitive to cable parameters such as return loss, attenuation, crosstalk, ACR, delay skew, far end crosstalk and impedance, relative to the existing data cables.

Cabling standards organizations and developers seem to focus on developing products to enhance Ethernet and do not appear to be concerned about open architecture. Thus, it is desirable to incorporate a design of true open architecture, thereby providing maximum available bandwidth for all systems operations. This is necessary, given the fact that Ethernet technology was originally designed based on transmission rates of 10 Mbps and has already been pushed upward by a factor of 100 times. As a result, it is only a matter of time before a new high speed networking technology platform will have to be established to achieve improved data rates and effectively network high speed terabit operating equipment.

SUMMARY OF THE INVENTION

A low loss data cable of the present invention includes a plurality of conductor pairs combined to form a core. Each conductor pair is defined as coupled braided conductors where each conductor encircles its coupled conductor. Each conductor encircling is defined as a pair lay length. A first insulating material layer separately insulates each of the conductors. A second insulating material layer surrounds a core which includes the conductor pairs in a twist formation where each of the conductor pairs encircles a center gap separating all of the conductor pairs. When each conductor pair encircling is defined as a core lay length, the pair lay length of each of said conductor pairs is no greater than about one third of the core lay length. In a preferred embodiment of the invention, the pair lay length of each of the conductor pairs is less than about one fourth of the core lay length.

Each of the conductors is at least respectively about 92% centered in the first insulating material. Furthermore, the core is at least about 92% centered in the second insulating material.

The first insulating material has a dielectric constant of less than about 2.5, and less than about 2.3 in a preferred embodiment. The first insulating material includes pure fluorinated perfluoethylene polypropylene, and polyethylene having a minimal amount of copper added thereto, which is sufficient to provide a stabilizing effect. The first insulating material also has a loss tangent of less than about 0.009, and may alternatively comprises at least one of polyfluoroalkoxy, TFE/perfluoromethylvinylether, and polytetrafluoroethylene. The second insulating material has a dielectric constant no greater than 3.5, and less than about 3.2 in a preferred embodiment.

Also, in a preferred embodiment of the invention the center gap consists of air. Alternatively, the center gap can include a filler made of a foam or solid material, having a dielectric constant no greater than the dielectric constant of the first or second insulating material. The filler can include at least one of polypropylene, polyethylene, fluorinated ethylene-propylene, polyfouoroalkoxy TFE/perfluoromethylvinylether, ethylene chlorotrifluoroethylene, polyvinyl chloride, low smoke zero halogen, and thermoplastic elastomer.

Each of the conductors in the present invention has a maximum size of 22 AWG. Furthermore, the cable has an outer diameter no greater than 0.25 inches.

A method of manufacturing a low loss data cable according to the present invention includes the following steps. First, insulating a first conductor within a first dielectric material so the conductor is at least about 92% centered in the first dielectric material. Second, a predetermined amount of balanced tension is applied on the conductor and on a second conductor insulated as described above, while braiding the first and second conductors to encircle each other as a first pair, where each encircling is defined as a pair lay length. Third, a predetermined amount of balanced tension is applied on the first pair of conductors and on a second, third, and fourth pair of conductors provided according to above steps, while braiding the first, second, third, and fourth pairs to encircle a center gap. The center gap separates all of the pairs from each other, each pair encircling being defined as a core lay length. Fourth, the first, second, third, and fourth pairs are insulated together as a core within a second dielectric material so that the core is at least about 92% centered in the second dielectric material. The pair lay length of each of the pairs is no greater than about one third of the core lay length.

As explained above, in a preferred embodiment of the invention the pair lay length of each of the pairs is less than about one fourth of the core lay length.

The step of insulating a conductor should be performed while ensuring moisture removal and maintaining dryness in order to prevent formation of pores in the conductor and/or the insulating material.

BRIEF DESCRIPTION OF THE DRAWINGS

FIG. 1 is a sectional view of a prior art cable.

FIG. 2 shows each twisted pair in the twisted pair cable of the present invention, and exemplifies pair lay lengths.

FIG. 3 is a perspective view of a twisted pair cable according to the present invention.

FIG. 4 is a sectional view of an insulated conductor, and exemplifies centering of the conductor.

DESCRIPTION OF THE PREFERRED EMBODIMENT

Figure 5:
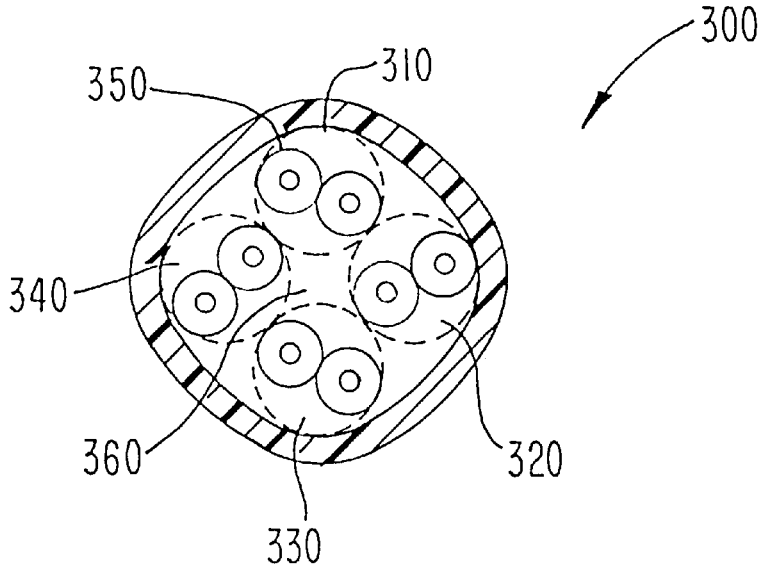
FIG. 5 is a sectional view of an illustrative embodiment of the low loss data cable shown in accordance with the present invention.

The following is a description of the preferred embodiment of the invention, which provides a product designed to optimize electrical performance of unshielded twisted pair cables in a manner such that the cable allows for maximum bandwidth and transmission distance when compared with all known signaling techniques over twisted pair copper for local area networks. As mentioned previously, signal transmission depends on impedance or smoothness of the impedance. Impedance fluctuations have an average or characteristic value (typically about 100 Ohms) due to slight variations in the production of the product. This average or characteristic value is designed into the product of the present invention such that the cable matches the output and input impedance of the device it is connected to. The standard for this impedance has been 100 Ohms.

There are several factors that cause impedance to fluctuate along the length of a cable. Key factors contributing to impedance fluctuations along the length of a cable include: conductor-to-conductor centering; uniformity in insulating dielectrics; air gaps between conductors of a pair; and pair-to-pair relationships.

Input or actual measured impedance of a cable is largely influenced by conductor centering within its insulation, as well as conductor ovalness and insulated conductor ovalness. Secondary parameters affecting input impedance performance include insulation purity, pair lay lengths (distance between successive twists), pair to pair relationships, overall cable lay length and jacket tightness.

Conductor centering is measured, and expressed as a percentage, by dividing the maximum insulation wall thickness by the minimum wall thickness. FIG. 4 shows a sectional view of an insulated conductor 200 and exemplifies how centering of the conductor in the insulation 210 is defined. The expression of centering assumes perfect ovalness of the copper and insulated wire. Ovality of the copper used in conductors is controlled by establishing stringent requirements and routine insulation tip and die inspection/maintenance schedules. The low loss data cable of the disclosed invention maintains a minimum of about 92% conductor centering.

To maintain a consistent insulating medium, the low loss data cable of this invention is preferably insulated with an insulating material 210 such as pure fluorinated perfluoroethylene polypropylene (FEP) and polyethylene with a small amount of copper stabilizer added. Other insulating materials that may be used include polypropylene (PP), polyfluoroalkoxy (PFA) and TFE/perfluoromethylvinylether (MFA). This creates a chemically linked material over the copper conductor 200, assuring even and consistent dispersion of all molecules. Use of a pure insulation material also helps minimize reflections. Furthermore, a highly controlled environment is utilized in manufacturing the low loss data cable of the invention to ensure that the cable does not suffer from porosity, i.e., air pockets, that are generally introduced in cables during processing. The controlled environment maintained during manufacturing of the low loss data cable of the invention includes drying equipment and moisture analyzer equipment to assure proper drying of compounds to eliminate air pockets and any associated porosity.

Air gaps between conductor pairs in the low loss data cable of the invention are controlled by maintaining balanced tensions on the wire of a pair at twinning. The above may also be achieved by using a tight-enough pair lay to overcome slight unbalances in tension and avoid distortion during the stranding of the pairs together. Increased lay lengths translate to increased characteristic impedance performance. This is because the characteristic impedance performance is inversely proportional to the number of twists per foot. However, as the lay lengths increase, care must be taken to ensure that distortion and deformation does not occur from handling and tensioning of the wire in further processing. Individual pair lay lengths (11), as shown in FIG. 2, should not exceed ⅓ of the overall cable lay length (12), as shown in FIG. 3.

Pair-to-pair spacing in prior art cables has generally been the single most random characteristic of 4-pair cables 100, as shown in FIG. 1. In the arrangement shown in FIG. 1, the balance of the dielectric medium is lost, as the fields (shown as dotted lines in FIG. 1) associated with conductor pairs comprising such a cable 100 have to travel through different material types having different dielectric constants resulting in signal loss. In contrast, in the low loss data cable of the present invention, pair-to-pair spacing is controlled through light and precise balancing of tension on the pairs as they are stranded together to form the core, as shown in FIG. 5.

By maintaining light, balanced tensions on and between pairs 320, 330, 340 and 350 as they are stranded together, it is possible to maintain the air gap 360 in the center of the core, as shown in FIG. 5. To hold this desired arrangement in place as the pairs rotate, it is essential to keep the pair lays 11 less than about 33.3% of the overall core lay 12 to prevent nesting. In a preferred embodiment, the ratio is less than about 25%.

Figure 6:
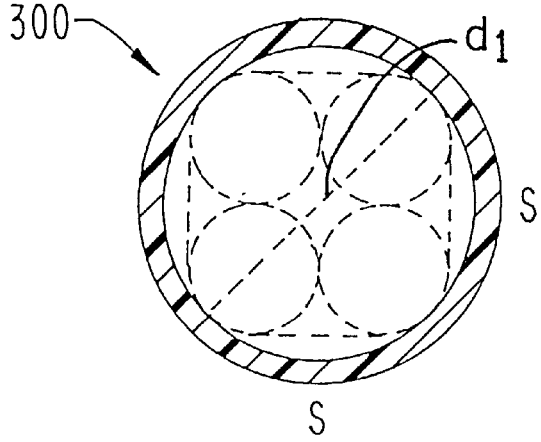
FIG. 6 is a sectional view of a low loss data cable showing the relationship between the central air gap and the diameters of the twisted pair cables in accordance with the present invention.

In addition, it is also essential to have a tight, well centered jacket 310 over the core to hold the desired configuration. Furthermore, care should be taken in placing even tension on each of the pairs 320, 330, 340 and 350 comprising cable 300 when setting-up the jacket line to avoid pulling a single pair into the central air-gap. Ideally, the air gap 360 is sized according to the configuration shown in FIG. 6, where the four pairs 320, 330, 340, and 350 form corners of a square. In such a case, each side of the square S is approximately two times the diameter of the circle formed by the insulating material 210 surrounding each pair 320, 330, 340, and 350. Thus, the inner diameter $d_1$ of the jacket 310 approximately equals the square root of $2S^2$, or, in other terms, d1 approximately equals S*sin(45).

Figure 7:
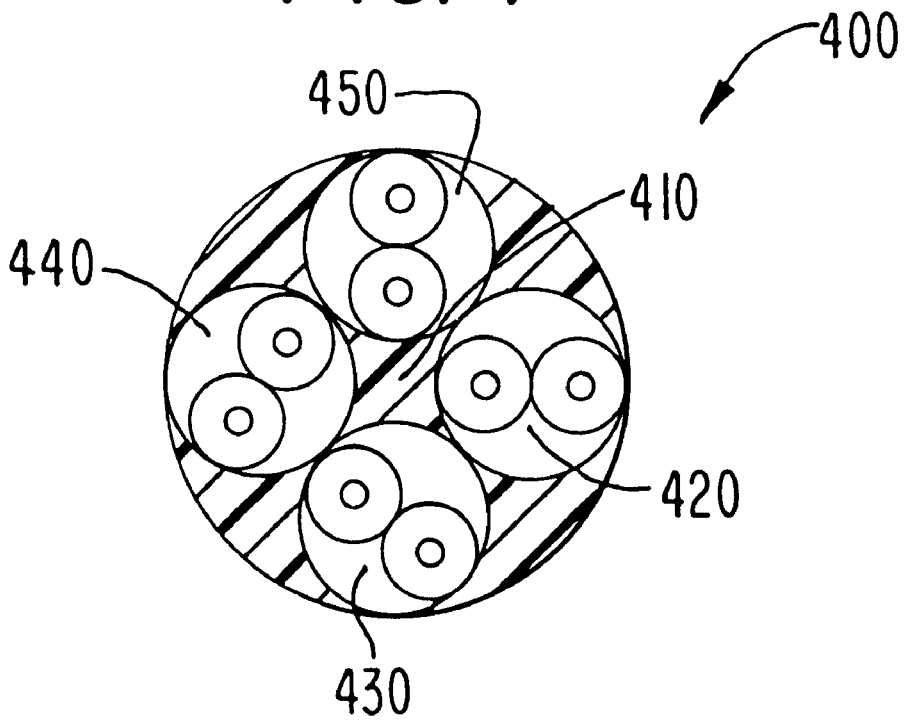
FIG. 7 is a sectional view of another illustrative embodiment of a low loss data cable in accordance with the present invention using a filler instead of an air gap.
Figure 8:
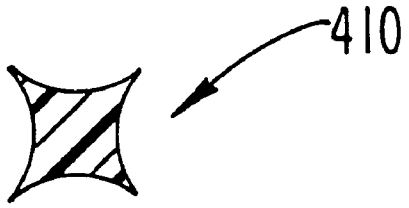
FIG. 8 is a sectional view of an embodiment of a filler material used to separate pairs of conductors from each other in the embodiment of the invention shown in FIG. 7.

Pair-to-pair spacing may also be achieved through the use of central filler 410 in cable 400 as shown in FIGS. 7 and 8. Central filler 410 would ideally support pair 420 from pair 440, and pair 430 from pair 450, but would not physically separate adjacent pairs. The filler may be made of solid plastic, or it may have a hollow core for increased air dielectric space.

Attenuation represents signal loss or dissipation as an electrical signal propagates down the length of a wire. Attenuation is also influenced by input impedance. Input impedance fluctuations about the characteristic impedance value represent signal reflections (return loss). The percentage of reflected energy versus transmitted energy increases as frequency increases. It is due to this increase in reflected energy that it is possible to see spikes in attenuation, loss curves, especially at frequencies in excess of 100 MHz. These spikes represent signal loss due to reflections. Reflections occur due to variations in the structure of a twisted pair that cause input impedance to deviate from its targeted characteristic value.

The signal return loss or reflections is what is actually detected and measured by the input impedance fluctuations. Return loss does not actually show up on attenuation curves throughout the frequency range. This is simply due to the fact that the normally reflected signal is a small percentage of the transmitted signal. This characteristic, however, changes as higher transmission frequencies are reached or the-length of cable becomes excessive, causing the transmitted signal to be highly attenuated. Due to established impedance controls, this attenuation does not appear on attenuation charts until the loss exceeds 25 db. By adequately controlling the above described parameters, including using pure insulation materials, the amount of signal loss due to reflections (return loss) is significantly reduced.

Attenuation is dependent on the dielectric constant and dissipation factor (loss tangent) of the insulating material surrounding a conductor, characteristic impedance of the wire, conductor surface area due to skin depths and surface conductivity, impact on resistance and the diameter of the copper conductor throughout the frequency range of interest. According to the EIA/TIA 568-A standard, conductor size has to be in the range of 22 AWG (American wire gauge)–24 AWG to work with standard based connecting hardware, while maintaining individual insulated conductor outside diameter of 0.0481" or less and an overall cable outside diameter no greater than 0.250".

In keeping with current industry standards and allowing the low loss data cable of this invention to work with standard terminating hardware, the low loss data cable of the invention holds a 22 AWG maximum conductor size. The chosen conductor size provides the low loss data cable with the greatest allowable surface area and lowest resistive losses, while remaining within industry standards (e.g., can be terminated on industry standard 110 style insulation displacement connectors) and providing telecommunications connecting hardware capabilities.

The conductor resistance also impacts attenuation, especially the surface conductivity of the conductor as frequencies increase. This is due to the fact that the skin depth, or conductive cross section area is decreasing. To enhance the conductivity ultra pure copper, or oxygen free copper can be employed or alternative conductor materials or conductor coatings such as silver and gold if economics permits. The dielectric constant impacting attenuation is actually an effective dielectric medium made-up of different materials. The fields between conductors of a pair are attenuated as they travel through air or material separating them. The speeds at which these signals travel also depend upon the material the signal travels through. For example, if the field associated with one of the conductors of a pair travels through a different material (having a different dielectric constant) than the field associated with the other conductor making the pair, the two fields will arrive out of phase and cause signal loss.

It is preferable to keep the dielectric constant associated with different materials in a cable as low as possible and balanced on both sides of the pair center plane to prevent phase shifts due to dielectric boundary conditions. In addition, these materials must also be selected such that they meet industry fire safety testing requirements.

A sub-parameter that is also important to keep as low as possible is the material's loss tangent. Dissipation factor or loss tangent is normally viewed as an insignificant contributor to signal loss until it exceeds 0.1. It is at this point (transition from a low loss dielectric to a lossy dielectric) when conductance becomes a significant factor in evaluating signal loss. The effect must be evaluated on a material by material basis, to assure a stable low loss tangent throughout the frequency range and the temperature range at which a cable will be operated. These values for determining the impact of the loss tangent are only guidelines and, as will be recognized by those of skill in the art, require interpretation, especially with UTP products operating above 100 MHz over lengths of 100 meters (attenuation is greater than 20 db). The added loss due to dissipation factor properties of dielectric materials may become significant in calculating the total loss, even though the loss tangent may still be slightly less than 0.1.

In an ideal situation, the insulation of a pair would be a foamed dielectric, with the pair suspended in free air. This, however, is not feasible because systems require four pairs of conductors encapsulated by an overall jacket, where the total cable diameter does not exceed the required 0.250 inches established by TIA/EIA 568-A standards. Therefore, a low, highly balanced dielectric medium about the pair must be achieved.

To satisfy the above requirements, the low loss data cable of this invention uses solid insulating materials having a dielectric constant less than 2.3 (e.g., polyethylene and FEP) for the dielectric materials. The low loss data cable constructed according to the principles of this invention may also use solid, foamed or foam-skin insulation materials having a dielectric constant at or below 2.5 and a loss tangent less than 0.009. Other materials that can be used to achieve the requisite attenuation characteristics are, for example, polyfluoroalkoxy (PFA), TFE/Perfluoromethylvinylether (MFA) and polytetrafluoroethylene (PTFE).

Although foaming of the above materials would produce better attenuation results from a lower dielectric, technology available at the time of the present invention does not allow for effective processing in terms of the wall thicknesses desired. Moreover, foaming tends to create inconsistencies in the insulating dielectric that contribute to impedance fluctuations or return loss, especially in environments of elevated temperature or humidity. Foamed fluoropolymer materials and foam-skin materials tend to resist these environmental effects to a greater degree and may be ideal for use in a product built in light of this invention at some date in the near future.

The insulating dielectric represents only one of the materials of concern in determining the effective dielectric constant and balance across the pair center. Other factors that influence effective dielectric constant include: pair-to-pair relationship (if pair position changes the effective dielectric constant changes); dielectric constant of the jacket material; and the dielectric constant of the filler material (if applicable).

The low loss data cable of the present invention can be constructed using a filler made of a foamed or, solid material having a dielectric constant equal to or less than the dielectric constant of the insulating material. Suitable filler materials include polypropylene (PP), polyethylene (PE), fluorinated ethylene-propylene (FEP), polyfluoroalkoxy (PFA), FE/perfluoromethylvinylether (MFA) in solid or foamed form or foamed ethylene chlorotrifluoroethylene (ECTFE). When fire resistance is required, suitable filler materials include polyvinyl chloride (PVC), low smoke zero halogen (LSOH), thermoplastic elastomer (TPE) or ECTFE in solid form. Furthermore, the jacket's dielectric constant can also be the same as that of the insulating materials. Suitable jacket materials include PP, PE, FEP, PFA, MFA in solid or foamed form or foamed ECTFE. When fire resistance is required, suitable jacket materials include PVC, LSOH, TPE or ECTFE. However, the above-described construction may not always be economically feasible, given the necessary fire safety standards.

Because of the above-mentioned shortcoming in the selection of materials and their associated characteristics, the low loss data cable of the invention uses electrical performance criteria to determine an acceptable level of performance when selecting component materials. Using balanced tension control at cabling of the core and precise control of jacket tightness, the low loss data cable of this invention achieves attenuation performance without using central filler 410 described above and shown in FIGS. 7 and 8.

Given that WideBand operates at 167 MHz, it is desirable for the low loss data cable of this invention to maximize the robustness and transmission distance of the WideBand system. Accordingly, a specification of 22.7 db/100 meters maximum attenuation loss at 167 MHz was established.

In addition to achieving the established maximum attenuation loss, the low loss data cable of the invention also provides at least 10 db of worst pair ACR performance at or above 195 MHz to allow the same potential for future development and speeds using Ethernet technology as the high performance data cable disclosed in commonly-assigned U.S. patent application Ser. No. 09/062,059, filed Apr. 17, 1998 and incorporated herein by reference. To help achieve these performance criterions, a maximum limit-of 25.1 db/100 attenuation at 200 MHz and 33 db/100 meters at 329 MHz is instituted.

The low loss data cable of the invention, constructed in accordance with the features disclosed above that compensate for impedance fluctuations along the length of a cable (e.g., conductor-to-conductor centering, uniformity in insulating dielectrics, air gaps between conductors of a pair, pair-to-pair relationships, balanced tension control, optimized jacket tightness, etc.), exceeds the above established performance criterions.

An illustrative embodiment of the low loss data cable 300 of this invention shown in FIG. 5 performs with appropriate data capacity or headroom as required by the noted requirements. Low loss data cable 300 of FIG. 5 comprises PVC outer jacketing material 410 having a dielectric constant of 3.2 or lower throughout the frequency range of interest. However, a jacket material having a dielectric constant of 3.5 or less throughout the frequency range of interest would meet the established performance criteria for the low loss data cable of this invention.

Accordingly, the electrical performance of the low loss data cable of this invention may be improved through the use of solid or foamed jacketing materials having a dielectric constant and loss tangent better than PVC:

| Material | Dielectric Constant | Dissipation |
|---|---|---|
| PVC | 3.2 | 0.04 |
| LSPVC | 3.0 | 0.04 |
| ECTFE | 2.5 | 0.01 |
| FRPE | 2.5 | 0.001 |
| LSOH PE | 2.5 | 0.001 |
| FEP | 2.1 | 0.0005 |

The electrical performance of the low loss data cable may also be enhanced through the use of dual jacket layers of multiple solid materials or of an inner foamed material and outer solid material.

The low loss data cable constructed in accordance with the principles disclosed for the present invention exhibits a maximum attenuation of 21.3 db/100 m at 167 MHz, a maximum attenuation of 23.3 db/100 m at 200 MHz and does not exceed 33 db of attenuation when tested in the frequency range from 1 to 350-MHz.

The maximum attenuation values of the low loss data cable of this invention can be characterized by the following formulas:

$$\text{Attenuation } (f)=1.6*\text{sqrt}(f)+0.012*f+0.05/\text{sqrt}(f)$$

(where f=1 to 20 MHz)

$$\text{Attenuation } (f)=1.6*\text{sqrt}(f)+0.012*f+0.5/\text{sqrt}(f)$$

(where f>20 MHz to max. specified frequency)

The low loss data cable of the invention exhibits superior performance than the listed values in production mode. A product should hold an average of 5% margin throughout the frequency range during sample lot testing of-attenuation in production mode, where:

$$\%\ Attenuation\ Margin\ (f) = \frac{Spec\ (f) - Actual\ (f)}{Spec\ (f) * 100}$$

Having established and met or exceeded the above-mentioned performance criterions for attenuation, and having stayed within the physical limitations of 22 AWG copper and a maximum cable outside diameter of 0.25011 as established by the TIA/EIA 568-A standard, the low loss data cable of the invention also addresses the issue of near-end crosstalk. As described above, due to its low power signal, systems employing PECL technology are not concerned with crosstalk specifications. Ethernet systems on the other hand, are susceptible to crosstalk.

The low loss data cable of the invention is designed to meet the performance criteria established for the previously mentioned, commonly-assigned, high performance data cable, in terms of the key parameter of ACR for Ethernet support. Accordingly, the low loss data cable of the invention requires 10 db of worst pair-ACR at 195 MHz.

Crosstalk represents signal energy loss or dissipation due to coupling between pairs or between jacketed cables. The interaction between attenuation and crosstalk, i.e., attenuation-to-crosstalk ratio (ACR), provides a measure of cable performance. The greater the ACR, the more headroom or data capacity a cable has. While near-end crosstalk (NEXT) is a measure of signal coupling between pairs when measured at the input end of the cable, far-end crosstalk is a measure of signal coupling between pairs when measured at the output end of the cable.

In data networking cables, there is not only a concern regarding crosstalk between pairs within the jacketed cable, but also crosstalk between jacketed cables. Jacketed cable crosstalk, specifically between jacketed 4 pair cables, has become a major concern as gigabit speed networks emerge. The specific problem is between similar color pairs of two-jacketed cables which are in close proximity to one another. The like colored pairs, provided both cables are from the same manufacturer, have the same lay length and, therefore, high coupling. In order to minimize coupling between cables, three steps can be taken.

First, an overall shield can be applied to each cable to isolate the cables from one another. However, this solution is limited by the building ground. Since cabling is a distributed network within a building, it is subject to equipment interference, electrostatic interference and wireless transmissions. Thus, a uniform ground plane at both ends of the cable is virtually impossible. Without a uniform ground plane, the shield effectiveness can become erratic and unpredictable due to ground loops.

Second, cable core separation may be increased by increasing the 4 pair jacket thickness. The problem with such a solution is an increase in overall cable O.D. (outside diameter), which reduces conduit fill and cable tray fill. Reduced fill is a major concern of end users due to the increased cost of installation, especially as the number of 4 pair cables within a building increases.

The final solution is a dual jacket. The inner layer is a good insulator with a dielectric constant of 31.2 or less to minimize transmitted signal loss. The outer layer material is a higher loss material with a dielectric constant 3.5 or higher to attenuate crosstalk-coupling energy between 4 pair jacketed cables. The final solution eliminates difficulties in terminating the shield to a stable ground plane as well as holding jacketed cable diameters to a minimum.

Theoretically, crosstalk between pairs is proportional to the square of the distance between conductor centers of the energized pair and inversely proportional to the square of the distance between the center point of the energized pair and the receiving pair. Crosstalk coupling between pairs is also inversely proportional to the dielectric constant of the material separating the two pairs. Dissipation factor can also influence the amount of energy coupled between pairs, provided there is significant pair-to-pair separation and a relatively lossy material (loss tangent >0.1) is employed. However, a lossy material generally results in degraded attenuation performance, so the position of the material with respect to the conducting pair must be considered.

When using a 22 AWG 4 pair 100 ohm cable, there is virtually no room to add a separation member between adjacent pairs to the cable and still maintain the required O.D. of 0.250". However, by using 22 AWG wire, a net gain in crosstalk performance is received because the average separation ratio over a length of cable improves when using a 22 AWG wire in comparison to a 24 AWG wire, provided balanced tensions were maintained when the pairs were assembled together to form the core.

The low loss data cable of the present invention holds the near-end crosstalk to:

$$71-15*LOG(f/0.772)$$

using a lay scheme similar to or slightly longer than those commonly used in Level 6 cables (0.4511–0.9211). Thus, the individual pair lays do not have to be tightened to meet the established crosstalk requirement because doing so would result in deterioration of the attenuation performance of the low loss data cable.

Furthermore, a maximum near-end crosstalk value of 34.8 db at 195 MHZ and maximum attenuation of 24.7 db per 100 meters is established. These requirements result in a minimum ACR specification for 100 meter worst pair ACR of 10.1 db at 195 MHZ.

$$WP\text{-}ACR(f)=WP\text{-}NEXT(f)-ATTEN(F)$$

Since gigabit Ethernet is a multi-pair transmission system, the power sum ACR requirements are set at 10 db at 180 MHZ. With the worst pair near-end crosstalk, 100 meter ACR and attenuation established, the power-sum near-end crosstalk (PS-NEXT) and power sum ACR (PS-ACR) for the low loss data cable of this invention are derived:

$$PS\text{-}NEXT=68-15*LOG(f/0.772)$$

(in order to deliver PS-ACR @ 180 MHZ of 10 db minimum)

$$PS\text{-}ACR(f)=PS\text{-}NEXT(f)-ATTEN(F)$$

The other key parameters for both gigabit Ethernet support and systems employing technology like PECL are impedance and return loss. These parameters are most critical for systems utilizing full duplex transmission, i.e., simultaneous transmissions in both directions over a single pair, as excess reflection can cause the network interface device to attempt to interpret a reflection as transmitted data.

Based on the above and the benchmark established by the previously referred to and commonly-assigned United States patent application, the return loss and impedance requirements are set as follows:

Return Loss: 1–2 MHZ 20 db
2–20 MHZ 22 db
20–200 MHZ=22–5/log(S)*log(f/20)

Impedance 100+/−15, 1 to 100 MHZ
100+/−22, 100 to 200 MHZ
100+/−32, 200 to 300 MHZ The low loss data cable made in accordance with the principles of the present invention delivers optimal electrical performance for supporting and allowing for growth of networking technologies employing Ethernet-based technology or technology similar to PECL. At the same time, the low loss data cable continues to meet the following industry standard physical specifications:

| | |
|---|---|
| Conductor AWG: | 22–24 AWG |
| Max. Insulated O.D.: | 0.04811 |
| Max. Cable O.D.: | 0.25011 |

Having described an embodiment of the invention, it is to be understood that the invention is not limited to any of the precise embodiments described herein. Various changes and modifications could be effected by one skilled in the art without departing from the spirit or scope of the invention as defined in the appended claims.

What is claimed is:

1. A low loss data cable, which comprises:

a plurality of conductor pairs combined to form a core, each conductor pair comprising coupled braided conductors whereby each conductor encircles its coupled conductor with each conductor encircling being defined as a pair lay length;

a first insulating material layer, separately insulating each of said conductors; and a second insulating material layer, surrounding said core, said core comprising said plurality of conductor pairs in a twist formation whereby each of said plurality of conductor pairs in said core encircles a gap that is centrally disposed relative to said second insulating material layer, and that separates all of said plurality of conductor pairs with each conductor pair encircling being defined as a core lay length, wherein said pair lay length of each of said conductor pairs is no greater than about one third of said core lay length.

2. A low loss data cable as set forth in claim 1, wherein each of said conductors is at least respectively about 92% centered in said first insulating material.

3. A low loss data cable as set forth in claim 1, wherein said core is at least about 92% centered in said second insulating material.

4. A low loss data cable as set forth in claim 1, wherein said first insulating material comprises at least one of pure fluorinated perfluoroethylene polypropylene (PEP), and polyethylene, having a minimal amount of copper sufficient to provide a stabilizing effect added thereto.

5. A low loss data cable as set forth in claim 1, wherein said pair lay length of each of said conductor pairs is less than about one fourth of said core lay length.

6. A low loss data cable as set forth in claim 1, wherein said center gap consists of air.

7. A low loss data cable as set forth in claim 1, wherein said center gap comprises a filler comprising one of a foam or solid material, having a dielectric constant no greater than a dielectric constant of said first or second insulating material.

8. A low loss data cable as set forth in claim 7, wherein said filler comprises at least one of polypropylene, polyethylene, fluorinated ethylene-propylene, polyfouoroalkoxy TFE/perfluoromethylvinylether, ethylene chlorotrifluoroethylene, polyvinyl chloride, low smoke zero halogen, and thermoplastic elastomer.

9. A low loss data cable as set forth in claim 1, wherein each of said conductors has a maximum size of 22 AWG, and said cable has an outer diameter no greater than 0.25 inches.

10. A low loss data cable as set forth in claim 1, wherein said first insulating material has a dielectric constant less than about 2.5.

11. A low loss data cable as set forth in claim 10, wherein said dielectric constant of said first insulating material is less than about 2.3, and a loss tangent less than about 0.009, and comprises at least one of polyfluoroalkoxy, TFE/perfluoromethylvinylether, and polytetrafluoroethylene.

12. A low loss data cable as set forth in claim 1, wherein said second insulating material has a dielectric constant no greater than 3.5.

13. A low loss data cable as set forth in claim 12, wherein said dielectric constant of said second insulating material is less than about 3.2.

14. A method of manufacturing a low loss data cable, which comprises the steps of:

a) insulating a first conductor within a first dielectric material whereby said first conductor is at least about 92% centered in said first dielectric material;

b) applying a predetermined amount of balanced tension on said first conductor and on a second conductor insulated according to the insulating step, while braiding said first and second conductors to encircle each other as a first pair, each encircling being defined as a pair lay length;

c) applying a predetermined amount of balanced tension on said first pair of conductors and on a second, third, and fourth pair of conductors provided according to the insulating and applying steps, while braiding said first, second, third, and fourth pairs to encircle a center gap separating all of said pairs from each other, each pair encircling being defined as a core lay length; and d) insulating said first, second, third, and fourth pairs together as a core within a second dielectric material whereby said core is at least about 92% centered in said second dielectric material, wherein said pair lay length of each of said pairs is no greater than about one third of said core lay length.

15. A method as set forth in claim 14, wherein said step of insulating said first conductor is performed while ensuring moisture removal and maintaining dryness and a non-porous condition of said first conductor and said first dielectric material.

16. A method as set forth in claim 14, wherein said center gap consists of air.

17. A method as set forth in claim 14, wherein said first dielectric material has a dielectric constant less than about 2.3.

18. A method as set forth in claim 14, wherein said second dielectric material has a dielectric constant less than about 3.2.

19. A method as set forth in claim 14, further comprising:

e) providing a filler in said center gap, said filler comprising one of a foam or solid material, having a dielectric constant no greater than a dielectric constant of said first or second insulating material, said filler material comprising at least one of polypropylene, polyethylene, fluorinated ethylene-propylene, polyfouoroalkoxy TFE/perfluoromethylvinylether, ethylene chlorotrifluoroethylene, polyvinyl chloride, low smoke zero halogen, and thermoplastic elastomer.

20. A method as set forth in claim 14, wherein said pair lay length of each of said pairs is less than about one fourth of said core lay length.

* * * * *